US005855496A

United States Patent [19]

Lokken

[11] Patent Number: 5,855,496

[45] Date of Patent: Jan. 5, 1999

[54] OVERCENTER UPLOCK ASSEMBLY FOR AN OUTBOARD MOTOR

[75] Inventor: Mark T. Lokken, Oshkosh, Wis.

[73] Assignee: Brunswick Corporation, Lake Forest, Ill.

[21] Appl. No.: 514,273

[22] Filed: Aug. 11, 1995

[51] Int. Cl.[6] ..... B63H 5/125

[52] U.S. Cl. ..... 440/53

[58] Field of Search ..... 440/53, 55, 61, 440/63

[56] References Cited

U.S. PATENT DOCUMENTS

| | | | |
|---|---|---|---|
| 2,966,876 | 1/1961 | MacWilliam | 440/61 |
| 4,331,430 | 5/1982 | Lutzke et al. | 440/53 |
| 4,472,148 | 9/1984 | Kollock | 440/53 |
| 4,826,459 | 5/1989 | Slattery | 440/55 |
| 4,925,410 | 5/1990 | Boda | 440/55 |

*Primary Examiner*—Jesus D. Sotelo
*Attorney, Agent, or Firm*—Andrus, Sceales, Starke & Sawall

[57] ABSTRACT

An uplock assembly for an outboard motor tilt mechanism has a pair of brackets pivotally connected with an overcenter hinge. The uplock assembly has a lever that an operator uses to force the brackets into an in-line, end-to-end overcenter configuration in which a lower bracket supports against a horizontal support axle attached to the tilt mechanism and an upper bracket pushes against a swivel bracket of the tilt mechanism. The upper and lower brackets are sized so that the swivel bracket is pushed beyond its normal full up trailering position into a tight configuration in which the swivel bracket and motor are restrained from bouncing even under excessively rough transportation conditions. Preferably, the uplock assembly includes a lever guide member having a catch mechanism that secures the lever in a fixed position when the uplock assembly is engaged to support the outboard motor.

19 Claims, 5 Drawing Sheets

OVERCENTER UPLOCK ASSEMBLY FOR AN OUTBOARD MOTOR

FIELD OF THE INVENTION

The invention is an assembly to secure an outboard motor on the transom of a boat in a full up position. The invention is particularly useful for securing an outboard motor in a full up position under rough travelling conditions.

BACKGROUND OF THE INVENTION

U.S. Pat. Nos. 4,331,430, 4,472,148, 4,826,459, and 4,925,410, all of which are assigned to the assignee of the present invention, describe mechanisms for providing a variety of outboard motor tilt positions. The tilt positions typically include a series of lower trim positions, including one or more shallow water drive positions, and a full up trailering position.

In general, these patents describe tilt mechanisms having a transom bracket that is attached to the transom of a boat, and a swivel bracket that is pivotally mounted to the transom bracket. An outboard motor is rotatably mounted to the swivel bracket. The tilt mechanism allows the operator to change trim positions simply by pushing down on the motor tiller handle and tilting the motor up. A ratchet mechanism allows stepwise movement of a trim pin on the swivel bracket among serially arranged position notches in the transom bracket. This allows the motor to be tilted from the original down position to any higher position, including the full up position. Normally, a tilt strap or the like connects the swivel bracket to the transom bracket to prevent the motor from falling forward of the transom into the boat when the motor is in the full up position. To bring the motor back down to the lower drive position, the motor is tilted up to and slightly beyond the uppermost shallow water drive position, or slightly beyond the full up position, and released. Upon release, the trim pin follows a return path in a closed circuit cam track that returns the trim pin and motor to the down trim position as the motor tilts down.

U.S. Pat. No. 4,925,410 discloses a tilt mechanism lock which is manually operated to selectively lock the motor in the full up position so that the motor does not inadvertently dislodge from bouncing or jarring when the boat is transported. The lock mechanism disclosed in U.S. Pat. No. 4,925,410 operates satisfactorily under most conditions, however, under extremely rough conditions, the bouncing or jarring can cause damage to the lock mechanism or to other structure of the tilt mechanism (e.g. swivel bracket or trim pin). One example of this problem occurs in boating applications where a small outboard motor is used as an auxiliary drive. When a main drive is propelling the boat and the auxiliary drive is stowed in the full up position, pounding from heavy seas or high wave action can cause excessive bouncing and jarring. The excessive bouncing and jarring can damage the structure of the tilt mechanism for the auxiliary drive. Likewise, when an outboard motor is being trailered over the road in the full up position, excessive jarring can damage the structure of the tilt mechanism.

Under most conditions, tilt mechanisms are not damaged and do not break when transported in the full up position. However, some boat owners abuse the tilt mechanism by exposing it to excessive bouncing and jarring when the motor is in the full up position, thereby creating excessive stresses on the tilt mechanism. For these boat owners, it is desirable to provide a way to reduce movement and stresses in the tilt mechanism under excessively rough conditions.

SUMMARY OF THE INVENTION

The invention is an overcenter uplock assembly for an outboard motor tilt mechanism that provides additional support for the outboard motor when the outboard motor is in a full up position, and reduces stresses on the tilt mechanism due to excessive bouncing or jarring. The uplock assembly can be easily installed as an accessory to an outboard motor tilt mechanism. The uplock assembly is particularly useful when installed to support outboard motors being used as an auxiliary drive on a boat.

The lock mechanism described in U.S. Pat. No. 4,925,410 allows a small amount of clearance between the trim pin, and the locking shuttle and full up position notch when the motor is locked in the full up position. This clearance allows the motor to bounce slightly when being transported in the full up position. Persistent transportation in the locked full up position under rough conditions can lead to premature failure with the tilt mechanism or the locking functions.

In the preferred embodiment of the invention, the overcenter uplock assembly pushes the swivel bracket against the tension of the tilt strap which is connected to the transom bracket and the swivel bracket. The invention therefore removes clearance experienced in the full up position, and firmly supports the motor in a stable position. Even under rough conditions, using the overcenter uplock assembly renders it unlikely that the tilt mechanism will wear or fail prematurely.

In accordance with the invention, the overcenter uplock assembly has a lower bracket pivotally mounted to a horizontal support axle attached to the transom brackets of the tilt mechanism. An upper bracket is pivotally connected to the lower bracket with an overcenter hinge. The upper and lower brackets are stowed in a folded-over configuration. A lever connected to the upper bracket can be moved to position the lower and upper brackets in an in-line, end-to-end configuration. When the upper and lower brackets are positioned in an in-line, end-to-end configuration, the brackets support the outboard motor above the horizontal support axle between the transom brackets. The length of the upper and lower brackets is selected so that the brackets preferably push against the swivel bracket against the tension of the tilt strap. The upper and lower brackets are connected to each other with an overcenter hinge. The overcenter hinge facilitates use of the invention because it requires that the upper and lower brackets snap into the end-to-end relationship, and a positive effort is needed to disengage the brackets from the end-to-end configuration. In the preferred embodiment, the upper and lower brackets are made of fiber reinforced nylon. These brackets, as well as possibly other components in the tilt mechanism, compress and/or flex to enable the snap action of the overcenter hinge configuration.

The overcenter uplock assembly preferably includes a lever guide member that is mounted in a fixed position with respect to the transom brackets. The lever guide member has a guide slot through which the lever passes. The guide slot guides the path of movement of the lever. The lever guide member also has a catch mechanism that secures the position of the lever when the upper and lower brackets are positioned in the end-to-end configuration to support the swivel bracket. The catch mechanism is preferably located on the bottom of the lever guide member so that it can engage a transverse section of the lever when the upper and lower brackets are in the end-to-end configuration. The lever guide member also includes a handle to facilitate engagement and disengagement of the catch mechanism to the lever.

The overcenter uplock assembly of the present invention is typically stowed with the boat and motor, and is convenient to use. The invention does not require the use of conventional uplock mechanisms, and the use of conventional uplock mechanisms in certain systems can actually interfere with the use of the invention.

DETAILED DESCRIPTION OF THE DRAWINGS

Figure 1:
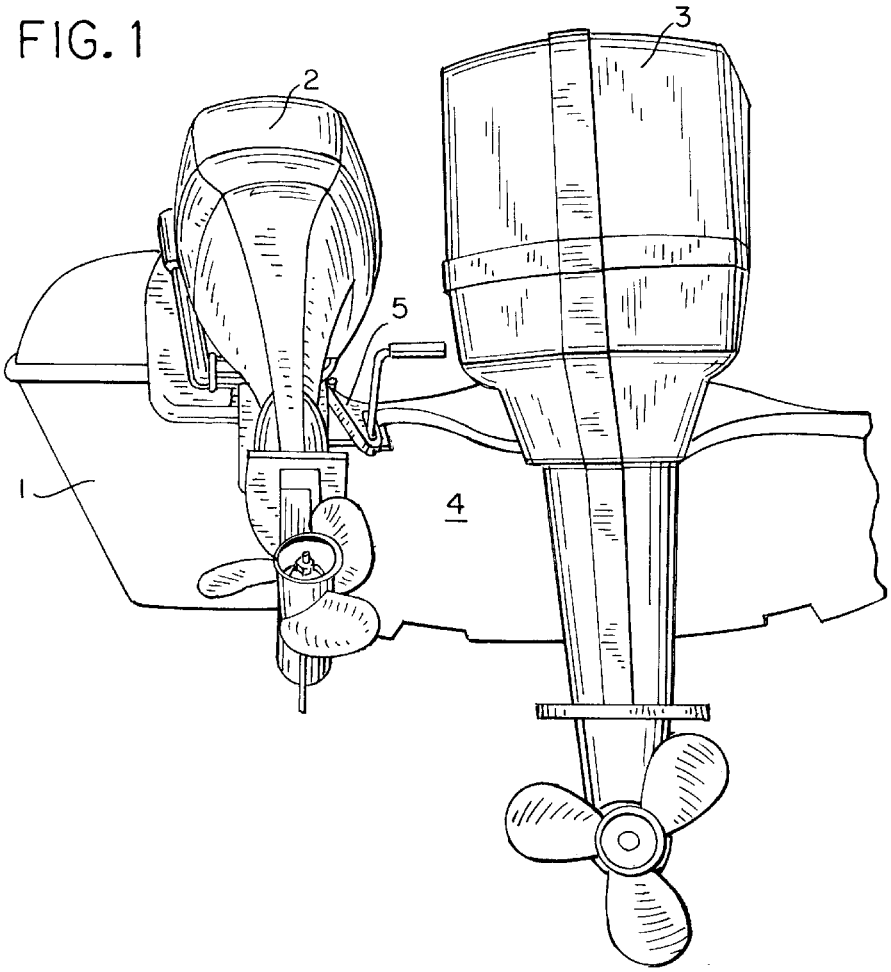
FIG. 1 is a perspective view showing a boat having an auxiliary drive utilizing an uplock assembly in accordance with the present invention.
Figure 2:
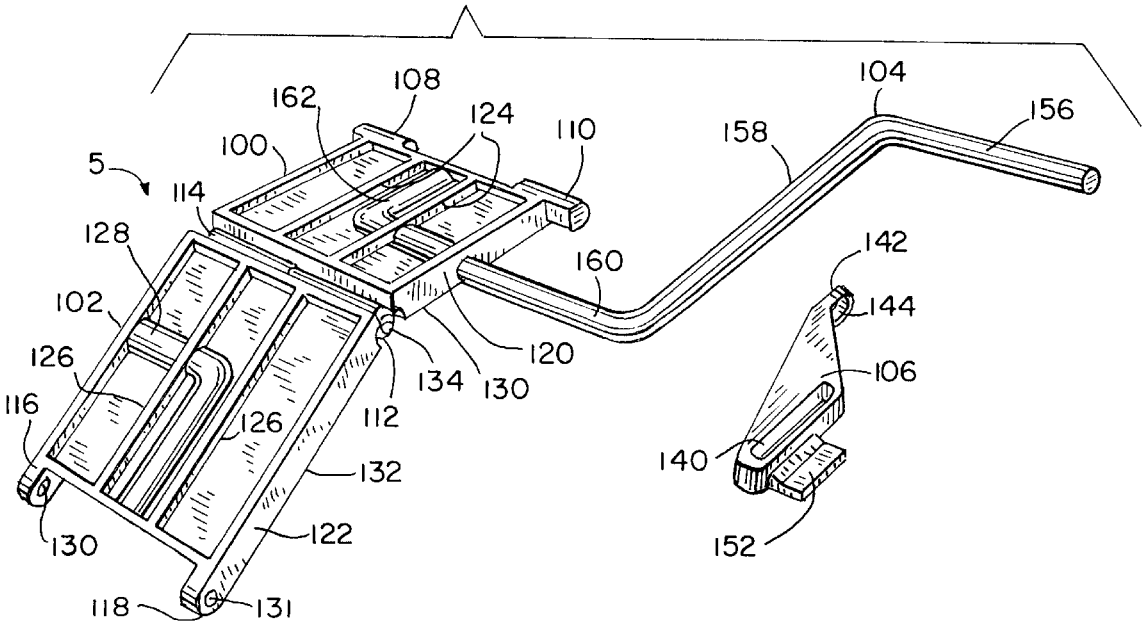
FIG. 2 is a view showing the parts of a kit assembly in accordance with the present invention.

FIG. 1 shows a boat 1 having a large outboard motor 3 mounted to a transom 4 of the boat 1 as a main drive, and a small outboard motor 2 mounted to the transom 4 of the boat 1 as an auxiliary drive. The main drive 3 is mounted in the center of the transom 4, and is shown to be trimmed in a down drive position. The auxiliary drive 2 is mounted to the transom 4 to the port side of the main drive 3, and is shown in FIG. 1 to be tilted in a full up position. An uplock assembly 5 in accordance with the invention is installed for use with the auxiliary drive 2. Component parts of the uplock assembly 5 are shown in FIG. 2.

FIGS. 3–7 show a tilt mechanism 10 for the auxiliary drive 2 using the uplock assembly 5. Except for the uplock assembly 5, the tilt mechanism 10 shown in FIGS. 3–7 is similar to the tilt mechanism disclosed in U.S. Pat. No. 4,925,410 which is herein incorporated by reference.

Referring to FIGS. 3–7, the tilt mechanism 10 includes a transom bracket 11 that is clamped to the transom 4 of the boat 1. A swivel bracket 14 is pivotally attached to the transom bracket 11 by a pivot tube 15 so that the swivel bracket 14 rotates around a first generally horizontal axis. The auxiliary outboard motor 2 is mounted on the swivel bracket 14 in a conventional manner for tilting movement with the swivel bracket 14 about the horizontal axis of the pivot tube 15.

Figure 3:
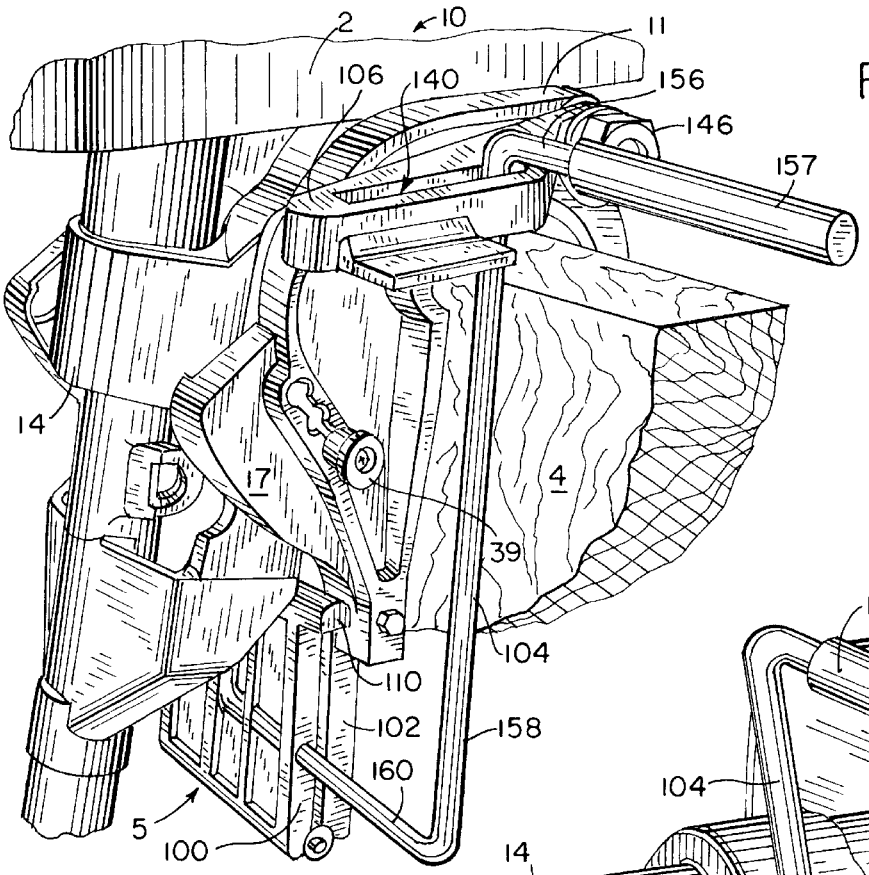
FIG. 3 is a perspective view from the starboard side of a tilt mechanism showing the preferred embodiment of the uplock assembly mounted to the tilt mechanism for an outboard motor.
Figure 4:
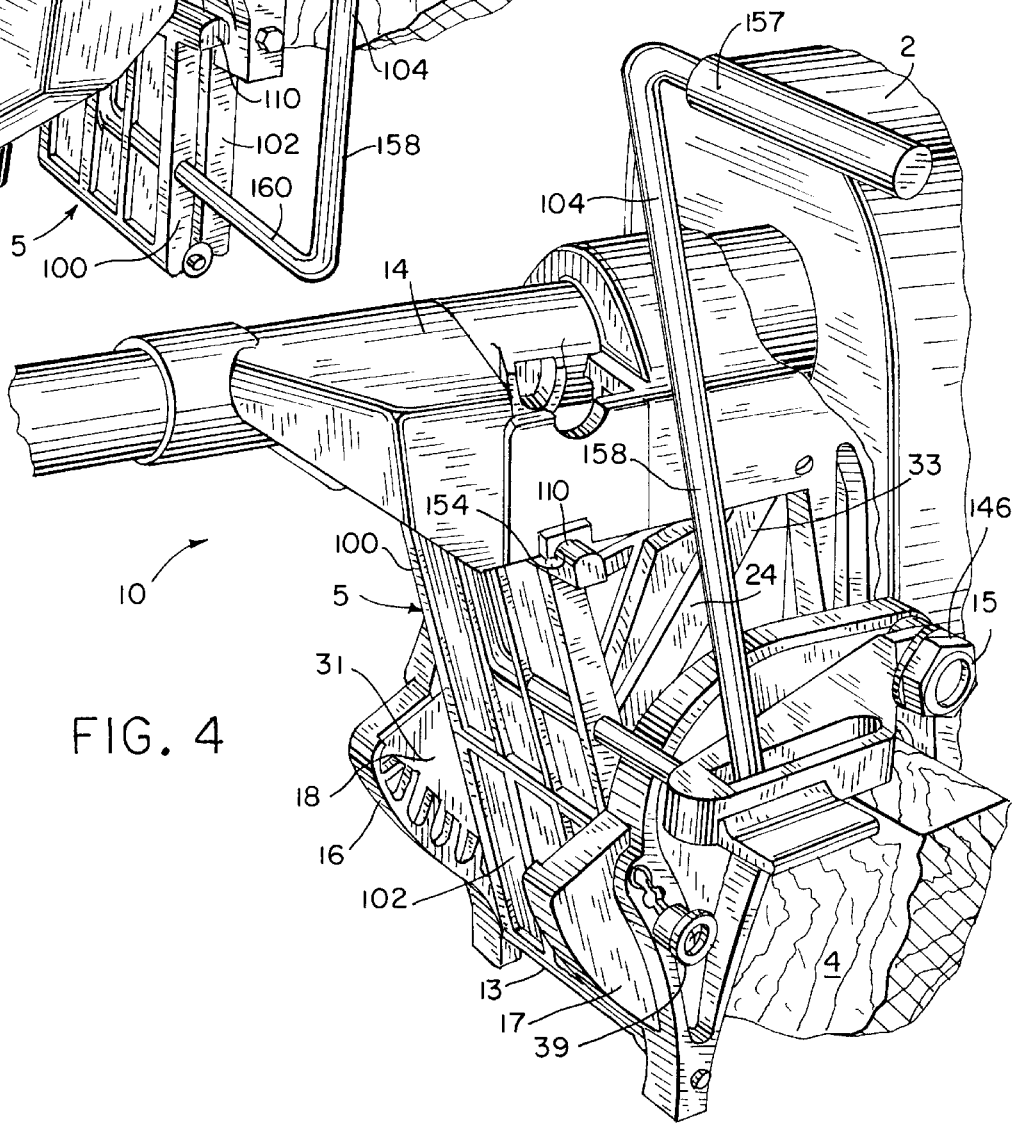
FIG. 4 is a perspective view showing the uplock assembly supporting an outboard motor.

In general, the transom bracket 11 has a closed circuit cam track 31 that includes a plurality of position notches circumferentially spaced about the first horizontal axis (i.e. the axis of the pivot tube 15), and a return cam track. A pawl assembly 33 is pivotally attached on one end of the swivel bracket 14 to rotate about a second generally horizontal axis. A trim pin 20 is attached to the other end of the pawl assembly 33. A biasing means 35 biases the trim pin 20 to engage the cam track notches to provide a series of trim positions, and to allow the automatic return of the swivel bracket 14 from the full up position to a lower trim position by returning the trim pin 20 along the return cam surface. The trim mechanism 10 can have an adjustably mounted return cam to allow the automatic return of the swivel bracket 14 from an upper position to a preselected lower trim position. As shown in FIGS. 3 and 4, manually operated knob 39 is connected to a movable cam which can be adjusted to modify the return cam surface for guiding the trim pin 20 to a preselected trim position notch, as disclosed in U.S. Pat. No. 4,472,148, which is incorporated herein by reference.

The parts of the tilt mechanism 10 most related to the operation of the uplock assembly 5 of the present invention are now described in more detail. The transom bracket 11 includes a port clamping member 16 and a starboard clamping member 17 which are held in spaced relationship by the pivot tube 15 and a lower tubular cross member 13. The lower tubular cross member 13 also serves as a horizontal support axle for the overcenter uplock assembly 5. As described in the above-incorporated U.S. Pat. No. 4,925,410, the clamping members 16 and 17 of the transom bracket 11 each have generally similar oppositely facing cam tracks 18 and 19. The cam tracks 18 and 19 are adapted to receive the ends of the trim pin 20 and hold the trim pin 20 in one of a series of tilt positions. The cam tracks 18 and 19 each has a set of corresponding notches, including a lower range of trim position notches 21, a shallow water drive notch 22, and an uppermost full up notch 23. The drive position notches 21, 22 are disposed in a generally circumferential spaced pattern about the axis of the pivot tube 15. The full up position notch 23 is spaced above the drive notches 21, 22.

The trim pin 20 is carried in the cam tracks 18 and 19 by a trim pin carrier 24 which is part of the pawl assembly 33. The trim pin carrier 24 is pivotally attached to the swivel bracket 14 by a pivot rod 25 for rotation about a second generally horizontal axis parallel to the axis of the pivot tube 15. The trim pin 20 is mounted on the lower free end of the trim pin carrier 24. As described in more detail in U.S. Pat. No. 4,925,410, the trim pin 20 can be manually shifted between the trim position notches 21 to adjust the tilt of the outboard motor 2. The tilt of the tilt mechanism 10 is adjusted by tilting the motor 2 and the swivel bracket 14 so that the trim pin 20 can ratchet up through the various trim pin position notches 21. A spring and cam track system, disclosed in the above-incorporated U.S. Pat. No. 4,925,410, is used to release the trim pin 20 from the trim position notches 21, 22, or the full up notch 23 when it is desired to lower the outboard motor 2 and swivel bracket 14.

The trim pin 20 normally bears the load of the outboard motor 2 when the trim pin 20 is located in one of the several position notches 21, 22, or 23. The load on the trim pin 20 tends to increase when a trim pin 20 is placed in the upper trim position notches such as 22, and especially when located in the full up notch 23.

Also disclosed in the above-incorporated U.S. Pat. No. 4,925,410 is a tilt locking mechanism 45 in which an operator can positively lock the trim pin 20 in the full up position notch 23, and prevent the trim pin 20 from inadvertently dislodging from the full up notch 23. As described in U.S. Pat. No. 4,925,410, the tilt locking mechanism 45 has a manually movable locking shuttle 46. The movable locking shuttle 46 can be moved between an unlocked position in which the movement of the trim pin 20 is unrestricted, and a locked position in which the locking shuttle is moved into a position to obstruct the trim pin 20 from dislodging from the full up notch 23. The locking mechanism 45 shown in U.S. Pat. No. 4,925,410 can be one in which the locking shuttle 46 allows the trim pin 20 to enter the full up notch 23 even when the locking mechanism 45 is in the locked position, but nonetheless prevents either intentional or inadvertent movement of the trim pin 20 out of the full up notch 23. Even when the trim pin 20 is locked in the full up notch 23 by the locking mechanism 45, the trim pin 20 can bounce against the trim pin notch 23 and the locking shuttle 46 when the boat is transported over rough conditions.

It has been found desirable to locate the locking shuttle 46 of the locking mechanism 45 tighter towards the full up notch 23 to reduce the amount of trim pin 20 bounce. When this is done, the trim pin 20 is not able to enter the full up position notch 23 when the locking mechanism 45 is in the locked position. While tighter positioning of the locking shuttle 46 reduces trim pin 20 bounce, it is typically not sufficient to protect the trim pin 20 and/or other parts of the tilt mechanism 10 from damage when the tilt mechanism 10 is continually abused under excessively rough conditions.

Figure 5:
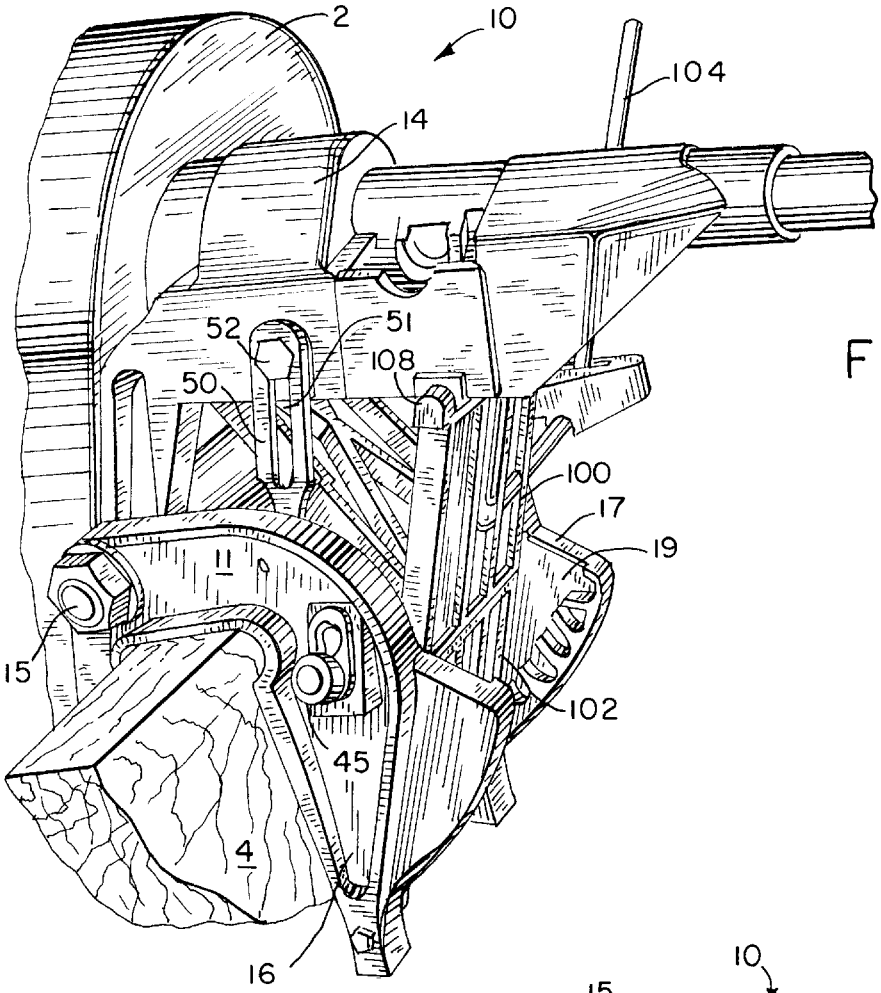
FIG. 5 is a perspective view similar to FIG. 4 from the port side of the tilt mechanism.

A tilt strap 50, preferably made of metal, is connected between the transom bracket 11 (i.e. the clamping brackets 16 and 17) and the swivel bracket 14 (see FIG. 5). The tilt strap 50 restrains the swivel bracket 14 from rotating beyond a maximum tilt position, and therefore prevents the swivel bracket 14 and the motor 2 from falling over the transom 4 into the boat 1. As shown in FIG. 5, the tilt strap 50 is slidably attached to the swivel bracket 14 with a bolt 52 through a slot 51 in the tilt strap 50.

The clearance available to the trim pin 20 when the pin 20 is locked in the full up position notch 23 allows the engine 2 to bounce up and down, especially in rough conditions. This type of bouncing, especially if continued over time, can cause the locking mechanism to break, the trim pin 20 to bend, or other parts of the tilt mechanism, such as the swivel bracket 14, to break. In accordance with the invention, the overcenter uplock assembly 5 can be engaged in an end-to-end relationship to support the outboard motor 5 and prevent this type of damage.

The locking mechanism 45 should be placed in the unlock position when using the uplock assembly 5. The uplock assembly 5 presses upwardly against the swivel bracket 14, pushes the trim pin 20 upwardly beyond the full up position notch 23, and supports the swivel bracket 14 and the motor 2. The uplock assembly 5 preferably pushes the swivel bracket 14 against the tension of the tilt strap 50, so that the swivel bracket 14 and the motor 2 do not bounce up and down.

Referring now to FIG. 2, the uplock assembly 5 includes an upper bracket 100, a lower bracket 102, a lever 104 and a lever guide member 106. The upper bracket 100 and the lower bracket 102 are preferably made of reinforced impact modified UV stabilized glass fiber nylon. Preferably, the brackets 100 and 102 are molded, generally flat members having similar dimensions, as shown in FIG. 2. Each of the brackets has a molded web surrounded by an outer wall 120 and 122, respectively, and internal reinforcement walls 124 and 126, respectively. The preferred wall thickness is 0.20 inches, and the preferred draft angle of the walls is 2° (except for the wall interface 136, FIG. 7, which should be flat). Each of the brackets 100 and 102 has a generally rectangular shape with an overcentered bushing 112 and 114, respectively, molded to one end of the bracket. The upper bracket 100 has a first bearing 108 and a second bearing 110 molded to the top edge 112 of the upper bracket 100. A pair of connecting lobes 116 and 118 are molded to the opposite end of the lower bracket 102.

The lever 104 is molded into the upper bracket 110 during the molding process. The lever 104 is preferably a ⅜ inch stainless steel rod. A lever such as lever 104 is not molded into the lower bracket 102. However, bridge 128 is molded into the lower bracket 102 because the same mold can be used for the upper bracket 100 and the lower bracket 102.

The lobes 116, 118 on the lower bracket 102 each have a hole 130, 131 therethrough having a radius of about 0.28 inches. The lobes 116, 118 on the lower bracket 102 are rotatably mounted around the lower tubular cross member 13. The tubular cross member 13 has internal threads on either end, and each end is attached to the respective transom bracket 16 or 17 with a bolt through the transom bracket.

Figure 8:
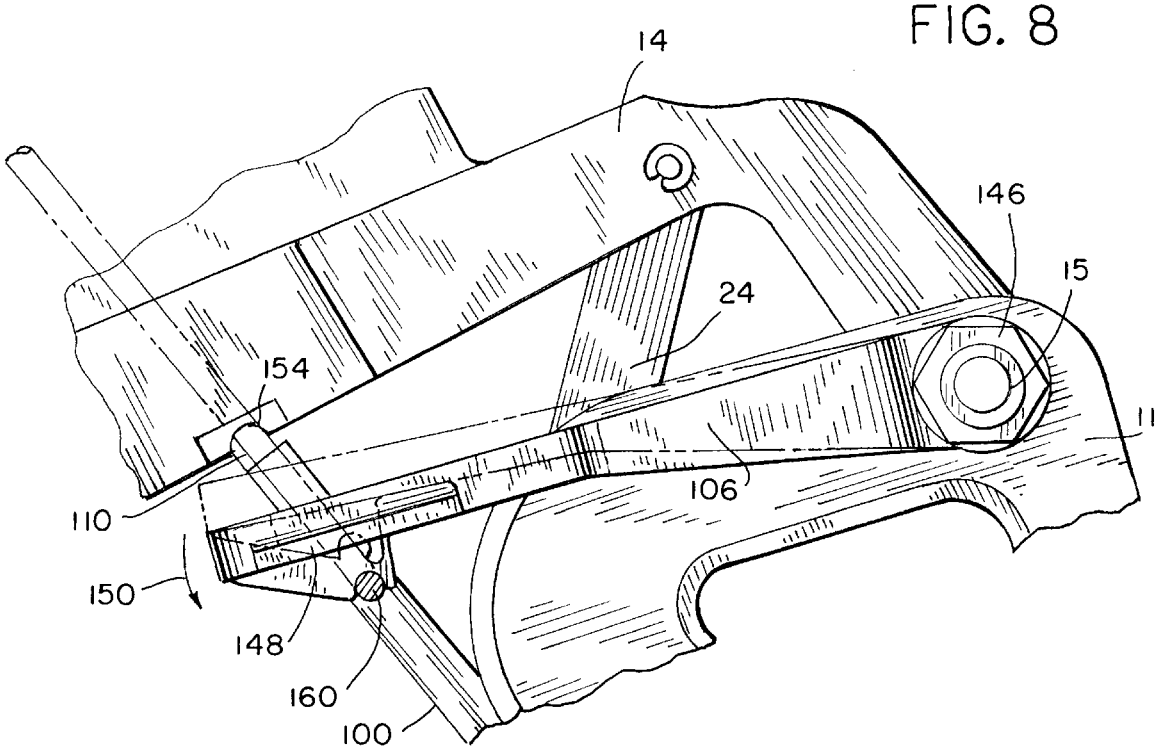
FIG. 8 is a detailed view showing the operation of a lever catch mechanism in accordance with the preferred embodiment of the invention.

As shown best in FIG. 8, the bearings 108, 110 on the upper bracket 100 engage the swivel bracket 14 in indentations 154 in the swivel bracket 14. Indentations such as indentation 154 are often located in swivel brackets or the like to allow clearance for trim pins or other components when the motor is in the down trim positions. The bearings 108, 110 provide for a continuous bearing surface that is preferably over an inch long. This inch long continuous bearing surface ensures that the swivel bracket 14 will not slip off the bearing surface even if the swivel bracket 14 shifts slightly in the transverse direction when the uplock assembly 5 is engaged in the maximum tilt position.

The overcenter hinge bushing 112 on the upper bracket 100 and the overcenter hinge bushing 114 on the lower bracket 102 are cylindrical bushings horizontally located so that the center of each bushing 112, 114 corresponds preferably with the inside edge 130, 132 of the brackets 100, 102. A hinge pin 134 is secured through overcenter bushings 112, 114 preferably using snap rings residing in grooves towards the end of the hinge pin 134. In operation, the load on the uplock assembly 5 is centered along the path between the horizontal support axle 13 and the support bearings 108 and 110 at the top of the upper bracket 100. As shown best in FIG. 7, when the uplock assembly 5 is positioned in an end-to-end relationship to support the swivel bracket 14, the overcentered hinge including the hinge pin 134 is offset from the load through the bracket 100, 102 towards the transom 4 of the boat 1. After the assembly 5 snaps into an end-to-end relationship, the assembly 5 is not likely to disengage unless the lever 104 is actuated.

The lever guide member 106 is preferably a molded part made of UV stabilized nylon. The lever guide member has a slot 140 for guiding the path of movement of the lever 104. The guide member 106 is mounted so that it does not move when the motor 2 and swivel bracket 14 are tilted. The guide member 106 is preferably mounted around pivot tube 15. The guide member 106 has a flange 142 with a mounting hole 144 therethrough. The guide member 106 is placed so that pivot tube 15 passes through hole 144. Nut 146 secures the guide member 106 around the pivot tube 115. The actual dimensions of the guide member depend in large part on the size of the tilt mechanism 10 that the uplock assembly 5 is being used with. In a typical application, the guide member 106 would have a length of about 7 inches, and the slot 140 would be offset about 2 inches from the flange 142. The length of the slot 140 would typically be about 3 inches long, and the width of the slot 140 would typically be slightly greater than the diameter of the lever 104. The slot 140 would typically be 2½ to 3½ inches rearward of the flange 142.

As shown best in FIG. 8, the lever guide member 106 has a catch mechanism 148 located adjacent to the slot 140. The purpose of the catch mechanism 148 is to retain the position of the lever 104 in a fixed position when the uplock assembly 5 has been engaged in an overcentered relationship to support the swivel bracket 14 and the motor 2 in the maximum tilt position. The catch mechanism 148 is a snap engagement element that can be snapped by an operator around lever 104 by pushing downward as shown by arrow 150 on the lever guide member 106. An operator can disengage the handle 104 from the catch mechanism 148 by pulling upwards (i.e. in the direction opposite to arrow 150). The catch mechanism has a handle 152 to facilitate the engagement and disengagement of the catch mechanism 148 from the lever 104.

The lever 104 has three right angle bends dividing the lever into four straight sections 156, 158, 160 and 162. Lever section 156 is a handle section that an operator grips to actuate the uplock assembly 5. A grip 157 can be attached around the handle section 156. Longitudinal section 158 is typically about 12 inches long. The length of the longitudinal section 158 is selected so that the handle section 156 rests on the top of the lever guide member 106 when the uplock assembly 5 is in its non-use position, shown best in FIGS. 3 and 6. The lever 104 includes a transverse section 160 that extends from the longitudinal section 158 into the upper bracket 100. The transverse portion 160 snaps into the catch mechanism 148 when the uplock assembly 5 is in the maximum tilt position. The length of the longitudinal section 158, as well as the mounting location of the catch mechanism 148 on the lever guide member 106 are selected so that the transverse portion 160 can snap into the catch mechanism 148 when the uplock assembly 5 is in the maximum tilt position. There is a bend in the lever 104 within the upper member 100 between the transverse section 160 and a leverage section 162. The leverage section 162 is helpful to securely fasten the lever 104 in the upper bracket 100.

Figure 6:
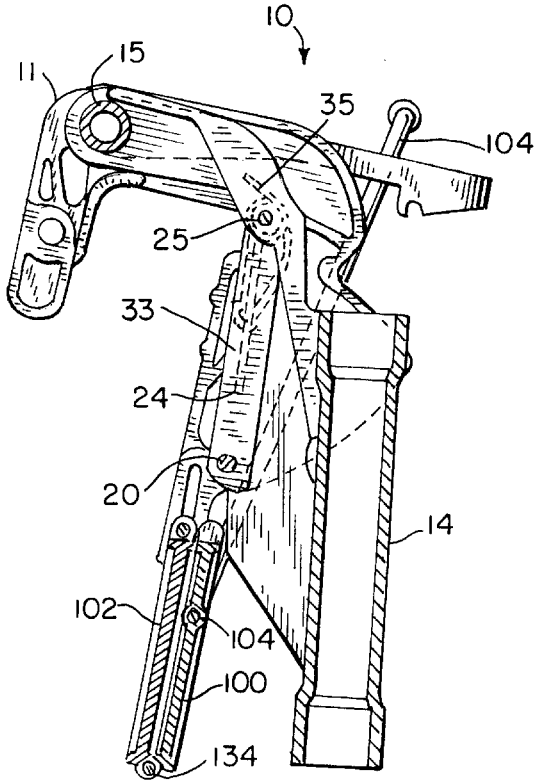
FIG. 6 is a side elevational view of a tilt mechanism having the uplock assembly of the present invention.
Figure 7:
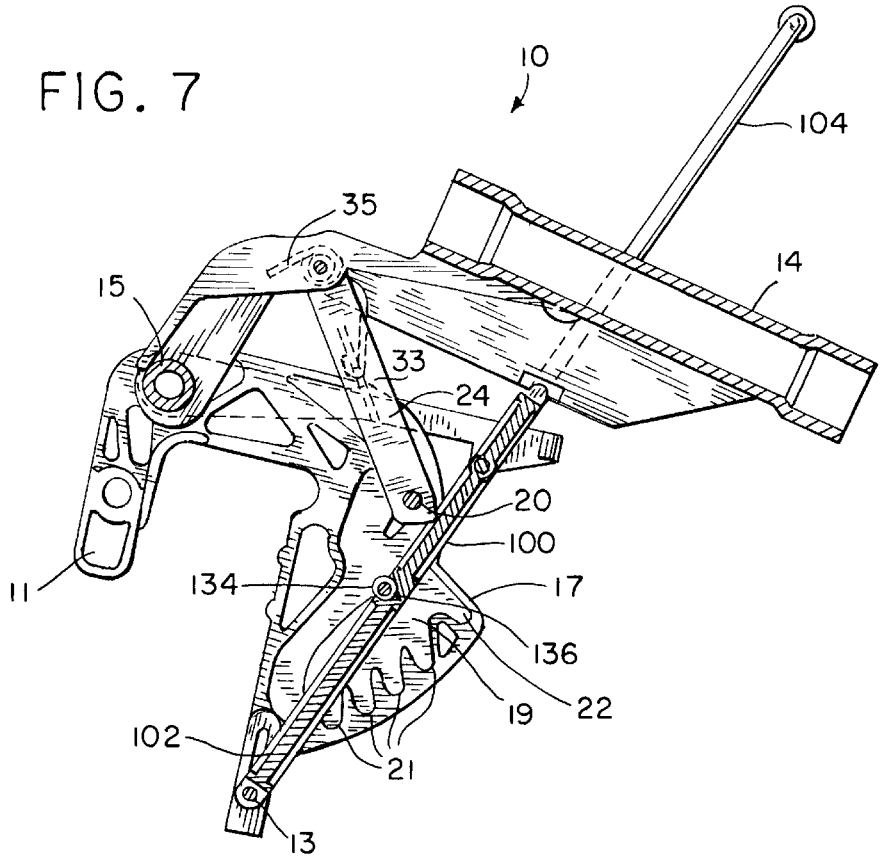
FIG. 7 is a side elevational view similar to FIG. 6 showing the uplock assembly in an in-line, end-to-end, overcenter configuration for supporting the tilt mechanism.
Figure 9:
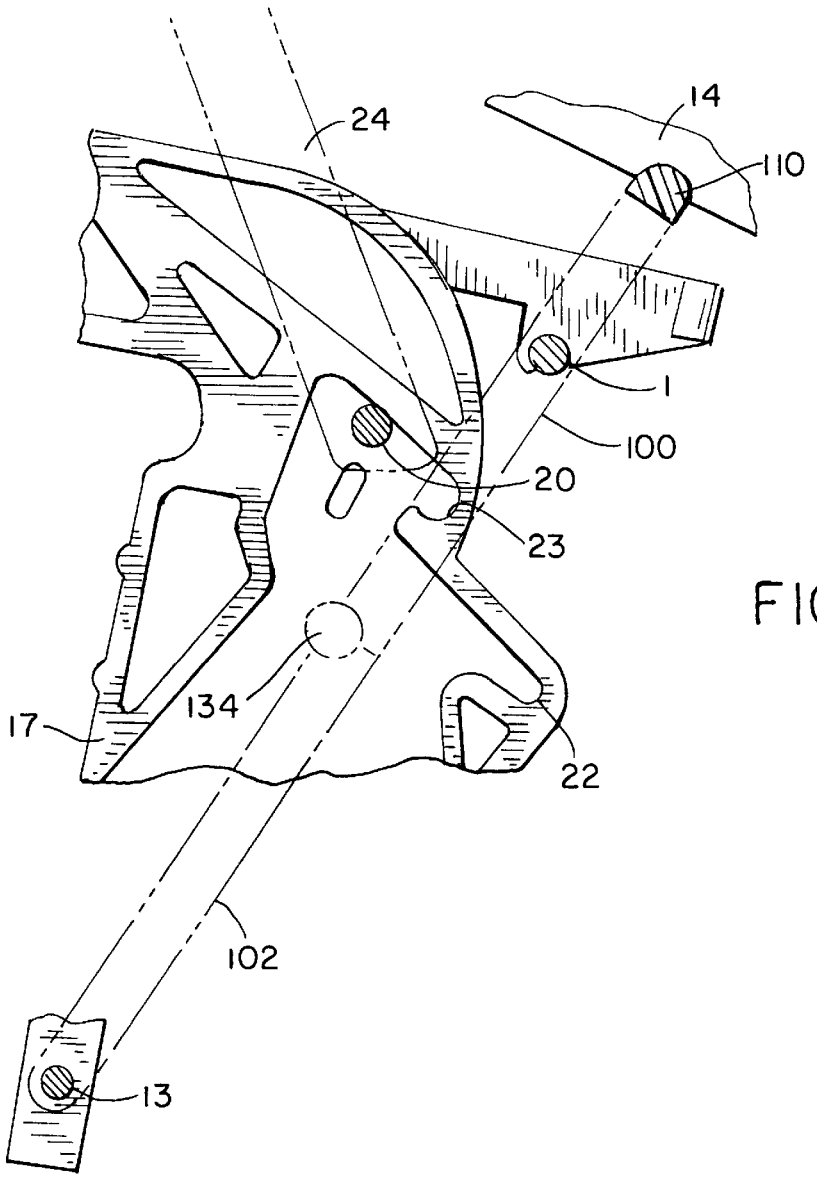
FIG. 9 is a detail section view taken along line 9—9 in FIG. 4 showing the location of one end of the tilt mechanism trim pin when the uplock assembly of the present invention is used to support an outboard motor in a maximum tilt position.
Figure 10:
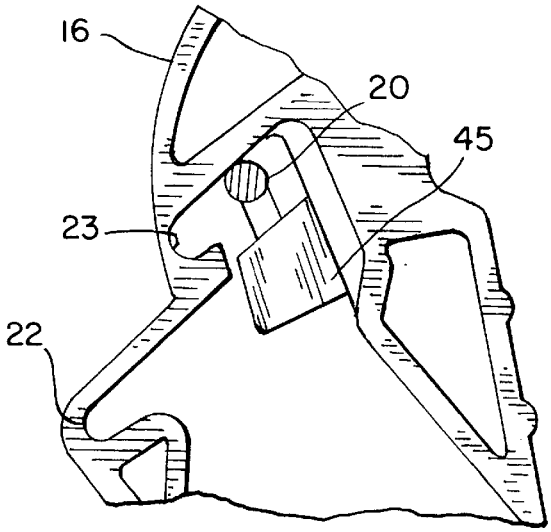
FIG. 10 is a view similar to FIG. 9 taken along line 10—10 in FIG. 5 showing the other end of the trim pin when the uplock assembly of the present invention is used to support an outboard motor in a maximum tilt position.

FIG. 6 shows the uplock assembly 5 stowed in its non-use position in which the upper bracket 100 and the lower bracket 102 are folded over one another. An operator can push forward on lever 104 to push the uplock assembly 5 into the maximum tilt position in which the brackets 100 and 102 are in an end-to-end, overcenter configuration as shown in FIG. 7. As the lever 104 is pushed forward and the bearings 108 and 110 on the upper bracket 100 push upward against the swivel bracket 14, the ends of the trim pin 20 are moved out of the full up position notch 23, see FIGS. 9 and 10. In addition, as the upper bracket 100 and the lower bracket 102 rotate around the overcenter hinge 134 to eventually be engaged in an end-to-end relationship, the bearings 108 and 110 on the upper bracket 102 push the swivel bracket 14 against the tension of the tilt strap 50. The combined length of the upper bracket 100 and the lower bracket 102 reaches a peak length before the brackets 100 and 102 are engaged in an end-to-end relationship. The peak length is typically achieved as the brackets 100 and 102 rotate around the hinge 134 slightly before snapping into end-to-end engagement. The size of the brackets 100 and 102 are chosen so that the combination of the brackets 100 and 102 pushes tightly against the tension of the tilt strap 50 when the brackets 100, 102 are in end-to-end relationship as shown in FIG. 7. Since the peak combined length of the brackets 100, 102 occurs before full rotation to an end-to-end relationship, the brackets 100, 102 (or some other component in the structure) must compress or flex to allow the brackets 100, 102 to engage in the end-to-end configuration. In the preferred embodiment, the brackets 100, 102 are made of fiberglass reinforced nylon, and compress upon engagement into an end-to-end relationship. When the brackets 100, 102 are rotated past the peak combined length, the brackets 100, 102 decompress, at least partially, and the brackets 100, 102 snap into the end-to-end relationship.

There are various modifications, alternatives and equivalents that will be apparent to those skilled in the art, and the following claims should be considered to include these various modifications, alternatives and equivalents.

I claim:

1. A kit for an uplock assembly that supports an outboard motor in a maximum tilt position comprising:

a lower bracket that can be pivotally mounted to a support axle in a fixed horizontal plane behind a transom of a boat;

an upper bracket pivotally connected to the lower bracket with an overcenter hinge; and a lever connected to the upper bracket;

wherein the lever can be moved to position the lower bracket and the upper bracket in an end-to-end relationship so that the combination of the upper and lower brackets support an outboard motor by bracing against the support axle.

2. A kit as recited in claim 1 wherein the upper and lower brackets are made of fiber reinforced nylon.

3. A kit as recited in claim 1 further comprising a lever guide member having a guide slot that guides the path of movement of the lever.

4. A kit as recited in claim 3 wherein the lever guide member also has a catch mechanism that secures the position of the lever when the upper and lower brackets are in an end-to-end relationship.

5. A kit as recited in claim 4 wherein the catch mechanism is a snap engagement element that can snap around the lever to secure the position of the lever.

6. A kit as recited in claim 5 wherein the lever guide member has a handle pad to facilitate engagement and disengagement of the snap engagement element to the lever.

7. A kit as recited in claim 1 wherein the overcenter hinge comprises a hinge pin that is positioned through an overcentered bushing on the lower bracket and an overcentered bushing on the upper bracket.

8. A kit as recited in claim 7 wherein the upper and lower brackets are substantially flat, rectangular members and the center axis of the hinge pin is substantially coplanar with the inside faces of the lower and upper brackets when the upper and lower brackets are positioned in an end-to-end relationship.

9. In a tilt mechanism for an outboard motor, the tilt mechanism including a transom bracket and a swivel bracket, the transom bracket attaching to a transom of a boat and having a first generally horizontal axis, the swivel bracket attaching pivotally to the transom bracket for rotation about the first horizontal axis to a plurality of trim positions and a full up position, the outboard motor being rotatably mounted to the swivel bracket, an uplock assembly for supporting the outboard motor in a maximum tilt position comprising:

a lower bracket pivotally mounted to a horizontal support axle attached to the transom bracket;

an upper bracket pivotally connected to the lower bracket with an overcenter hinge; and a lever connected to the upper bracket;

wherein the lever can be moved to position the lower bracket and the upper uplock bracket in an end-to-end relationship so that the combination of the upper and lower brackets support the outboard motor in the maximum tilt position.

10. The invention as recited in claim 9 wherein the transom bracket includes a cam track means having a plurality of trim position notches circumferentially spaced about the first generally horizontal axis and also an uppermost full up position notch, and the tilt mechanism further comprises a pawl assembly having one end pivotally attached to the swivel bracket for rotation about a second generally horizontal axis, the other end of the pawl assembly including a trim pin adapted to engage the position notches in the transom bracket for adjusting the tilt of the outboard motor, and wherein the trim pin bears no downward load when the upper bracket and the lower bracket of the uplock assembly are in an end-to-end relationship to support the outboard motor in the maximum tilt position.

11. The invention as recited in claim 9 wherein a tilt strap is connected between the transom bracket and the swivel bracket, and the combination of the upper bracket and the lower bracket push against the tension of the tilt strap when the upper bracket and the lower bracket are moved into the end-to-end relationship to support the outboard motor in the maximum tilt position.

12. The invention as recited in claim 9 wherein:

the swivel bracket has an indentation on a downward facing surface of the swivel bracket;

a support bearing is located on the top edge of the upper bracket; and the support bearing on the upper bracket engages the indentation on the downward facing surface of the swivel bracket when the upper bracket and the lower bracket are in an end-to-end relationship to support the outboard motor in the maximum tilt position.

13. The invention as recited in claim 9 wherein the upper and lower brackets are made of fiber reinforced nylon.

14. The invention as recited in claim 9 further comprising a lever guide member having a slot that guides the path of movement of the lever.

15. The invention as recited in claim 14 wherein the lever guide member has a catch mechanism that secures the position of the lever when the upper and lower brackets are in an end-to-end relationship.

16. The invention as recited in claim 15 wherein the catch mechanism is a snap engagement element that can snap around the lever to secure the position of the lever.

17. The invention as recited in claim 16 wherein the lever guide member has a handle pad to facilitate engagement and disengagement of the snap engagement element to the lever.

18. The invention as recited in claim 9 wherein the overcenter hinge comprises a hinge pin that is positioned through an overcenter bushing on the lower bracket and an overcenter bushing on the upper bracket.

19. The invention as recited in claim 18 wherein the upper and lower brackets are substantially flat, rectangular members and the center axis of the hinge pin is substantially coplanar with the inside faces of the lower and upper brackets when the lower and upper brackets are positioned in an end-to-end relationship.

* * * * *